US009551471B2

(12) United States Patent
Donners

(10) Patent No.: US 9,551,471 B2
(45) Date of Patent: Jan. 24, 2017

(54) LIGHTING SYSTEM HAVING GRIDS

(71) Applicant: PHILIPS LIGHTING HOLDING B.V., Eindhoven (NL)

(72) Inventor: Maurice Alexander Hugo Donners, Waalre (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 14/906,940

(22) PCT Filed: Jan. 27, 2015

(86) PCT No.: PCT/EP2015/051530

§ 371 (c)(1),
(2) Date: Jan. 22, 2016

(87) PCT Pub. No.: WO2015/117856

PCT Pub. Date: Aug. 13, 2015

(65) Prior Publication Data

US 2016/0341378 A1 Nov. 24, 2016

(30) Foreign Application Priority Data

Feb. 10, 2014 (EP) ..... 14154440

(51) Int. Cl.
*F21V 1/00* (2006.01)
*F21V 11/00* (2015.01)
(Continued)

(52) U.S. Cl.
CPC ..... *F21S 8/086* (2013.01); *F21V 5/04* (2013.01); *F21V 7/00* (2013.01); *F21V 13/04* (2013.01);
(Continued)

(58) Field of Classification Search
CPC ..... F21S 8/086; F21S 8/08; F21S 8/085; F21S 8/088; F21V 5/04; F21V 7/00; F21V 13/04; F21Y 2115/10; F21W 2131/103
(Continued)

(56) References Cited

U.S. PATENT DOCUMENTS

2008/0007509 A1* 1/2008 Lankhorst ..... G02F 1/133603 345/102
2008/0111471 A1* 5/2008 Blumel ..... F21K 9/00 313/502
(Continued)

FOREIGN PATENT DOCUMENTS

EP 2133621 A2 12/2009
EP 2397750 A1 12/2011
(Continued)

*Primary Examiner* — Bao Q Truong
*Assistant Examiner* — Glenn Zimmerman

(57) ABSTRACT

The invention provides a lighting system (1) comprising at least 16 lighting units (100) arranged in a grid (2) with in at least one direction center-to-center distances (d) between nearest neighbor lighting units (100) in the range of 4-16 mm, wherein each lighting unit (100) comprises a light source (110) and an optical element (20) configured to control a beam shape of light (101) generated by the light source (110), wherein each lighting unit (100) is conjured to generate said light (101) having a luminous flux of at least 100 lm and wherein the lighting system comprises as one luminous surface a plurality of grids (2), wherein between two nearest neighbor grids (2) an intermediate region (300) without a lighting unit (100) is configured, and with in at least one direction a shortest distance (d3) between nearest neighbor grids (2) of at least 35 mm.

13 Claims, 4 Drawing Sheets

(51) Int. Cl.

| | |
|---|---|
| ***F21S 8/08*** | (2006.01) |
| ***F21V 7/00*** | (2006.01) |
| ***F21V 5/04*** | (2006.01) |
| ***F21V 13/04*** | (2006.01) |
| *F21W 131/103* | (2006.01) |

(52) U.S. Cl.
CPC ..... *F21W 2131/103* (2013.01); *F21Y 2115/10* (2016.08)

(58) Field of Classification Search
USPC ..... 362/235, 236, 237, 249.02, 249.14, 238
See application file for complete search history.

(56) References Cited

U.S. PATENT DOCUMENTS

| | | | | |
|---|---|---|---|---|
| 2009/0166644 | A1* | 7/2009 | Hiroyama | G02B 6/0068 257/84 |
| 2010/0117100 | A1 | 5/2010 | Ogawa et al. | |
| 2010/0327752 | A1* | 12/2010 | Tamura | G09F 13/22 315/113 |
| 2013/0054197 | A1 | 2/2013 | Higashi et al. | |
| 2013/0107530 | A1 | 5/2013 | Wyrick et al. | |
| 2014/0339440 | A1* | 11/2014 | Schadt | H01L 25/0753 250/492.1 |

FOREIGN PATENT DOCUMENTS

| | | | |
|---|---|---|---|
| JP | 2007310251 | A | 11/2007 |
| JP | 2008117538 | A | 5/2008 |
| JP | 2011034892 | A | 2/2011 |

* cited by examiner

LIGHTING SYSTEM HAVING GRIDS

CROSS-REFERENCE TO PRIOR APPLICATIONS

This application is the U.S. National Phase application under 35 U.S.C. §371 of International Application No. PCT/EP2015/051530, filed on Jan. 27, 2015, which claims the benefit of European Patent Application No. 14154440.3, filed on Feb. 10, 2014. These applications are hereby incorporated by reference herein.

FIELD OF THE INVENTION

The invention relates to a lighting system comprising a plurality of lighting units. The invention further relates to a lamp (or lamp fixture) comprising such lighting system, as well as applications of such lighting systems or lamps.

BACKGROUND OF THE INVENTION

The problem of discomfort glare of lamps is known in the art. US2010117100, for instance, describes a light-emitting module which makes it difficult to sense glare and which suppresses the temperature rise of light-emitting diode chips and has a cost advantage. The light-emitting module is provided with a base body formed with a non-metallic member having a thermal conductivity of 1 W/mk or less. In the base body, a plurality of LED chips are spaced 10 to 30 mm apart from each other, and their junction temperature when they are normally lit is preferably set at 90° C. or less. A translucent sealing member covering an area between the adjacent light-emitting diode chips is provided.

US20130107530 discloses a lighting system comprising a plurality of lighting units in a plurality of grids, with a shortest distance between nearest neighbor grids of about 20 mm.

SUMMARY OF THE INVENTION

The present invention especially concerns LED (light emitting diode) luminaires for a large range of applications, such as for lighting of a road (including a street), a(n outdoor) sporting area, a façade, etc. (see also below). The present invention also concerns flood lighting (or area lighting), industrial lighting, such of plant sites or a factory (indoor), high-ceiling retail, etc. In all these cases, a high optical efficiency should be combined with an accurate distribution of the light. Therefore, optical systems using collimators or lenses are preferred over systems using reflectors. It appears that luminaires with diffuse or opaque windows lack both a well defined light distribution and a high efficiency; hence these were not further investigated (see also below).

It surprisingly appeared that e.g. a rectangular grid of LEDs, each with its own collimator, and having a pitch around 25 mm do not provide sufficient results in terms of efficiency, intensity and/or glare. When high to medium power LEDs are used in these systems on the one hand intensity might be obtained, but on the other hand glare appears unsatisfactory.

An issue with these luminaires is that e.g. road users, both car drivers and pedestrians, experience discomfort glare. Discomfort glare has been known for a long time already and also 'conventional' light sources can cause considerable discomfort glare. One example for this are compact HID lamps mounted in luminaires where the burner is in direct view of the road user. Both lighting professionals and naive observers report that they experience more discomfort glare from LED grids than from sources with homogeneous luminance distribution on the light emitting surface.

Hence, it is an aspect of the invention to provide an alternative lighting system and an alternative lamp including such lighting system, which preferably further at least partly obviate one or more of above-described drawbacks, but which is especially solid state source based, such as LED based.

Current models of discomfort glare consider a number of factors: (i) total luminance of the source or the resulting illuminance at the observer's eye; (ii) size (area) of the light emitting surface (LES) the position of the glare source in the field of view (eccentricity). As we take the intensity distribution and the eccentricity as fixed and given data, dictated by the lighting application, the only way to decrease discomfort glare is to increase the source size. For a (LED) grid, this would mean increasing the LED pitch, therewith increasing the 'apparent' total light emitting surface and so lowering the average luminance of the source (see also above). This is reflected by all known glare models, such as e.g. the Glare Index, or (such as for discomfort glare in road lighting) the glare control mark, introduced by Van Bommel and De Boer and accepted by the CIE in 1976, or the Visual Comfort Probability (VCP) model, or the Unified Glare Rating (UGR) model (especially for indoor lighting), or a more recent model for discomfort glare from outdoor lighting, developed by Bullough, based on illumination on the observer's eye, not taking into account the position, size or luminance of the source, etc.

It was surprisingly found that a combination of features, including a specific light source configuration and a grid with a pitch below about 16 mm provides substantial less glare than with a larger pitch. In a first aspect, the invention provides a lighting system comprising at least 16 lighting units arranged in a grid with in at least one direction center-to-center distances (d) between nearest neighbor lighting units in the range of 4-16 mm, wherein each lighting unit comprises a light source and an optical element especially configured to control a beam shape of light generated by the light source, wherein each lighting unit is configured to generate said light having a luminous flux of at least 50 lumen, even more especially at least 100 lm, and wherein the lighting system comprises as one integral luminous surface a plurality of grids, wherein between two nearest neighbor grids an intermediate region without a lighting unit is configured, and with in at least one direction a shortest distance (d3) between nearest neighbor grids of at least 35 mm.

Especially such lighting system may be used to illuminate large and high indoor areas and also outdoor areas. One may consider e.g. illuminating a surface, especially a floor or ground of an arena, a stadium, an opera, cinema, etc., or a road, a pedestrian area, a sidewalk, a bicycle lane, a square, high ceiling lighting, industrial indoor lighting, retail indoor lighting, hangar lighting etc. One may consider e.g. illuminating a surface, especially, an open place, a runway, an airstrip and a built-on area. Herein, the term "road" especially relates to paved roads which are designed for transport of motorized vehicles such as cars, automobiles, trucks, or motors. Herein the terms "runway" or "airstrip" especially relates to paved roads which are designed for take-off and/or landing of airplanes or aircrafts.

With the present system, surprisingly good and strong lighting systems may be provided with no or relative low (discomfort) glare. This is of course of interest for a person on the surface, including a person in a vehicle travelling on said surface. Such person may receive good lighting without substantial glare problems, which may increase experience, well-being and/or safety. Therefore, the invention especially provides a comfortable distributed LED lighting.

The grid may be irregular, a combination or regular and irregular, but is especially regular. The lighting system comprises a plurality of grids, wherein between two nearest neighbor grids an intermediate region without a lighting unit is configured, and with in at least one direction a shortest distance (d3) between nearest neighbor grids of at least 35 mm. Shorter distances between those individual grids may again lead to an increase of glare. The same aspects concerning the directions apply here with respect to the shortest distance between nearest neighbor grids. Note however that the distance taken is the shortest distance, and not the pitch. Hence, the distance of at least 35 mm is a distance wherein in principle no light sources are found. This part or these parts are herein also indicated as intermediate regions. The expression "one integral luminous surface" intends to express that the grids together are observed as one coherent light emitting part for commonly applied viewing distances of at least 3 meter. The distance between the grids preferably should not become too large, for example not larger than 85 mm or 100 mm, because of an undesired increased risk on lost of the 'coherence effect'.

As indicated above, each lighting unit has especially a luminous flux of at least 50 lumen (lm), such especially at least 100 lm. Even more especially, each lighting unit has especially a luminous flux of at least 125 lumen, such as at least 150 lumen. In principle, the lighting system may also include lighting units which have a mean luminous flux of at least 50 lumen, even more especially at least 100 lumen, yet even more especially at least 125 lumen, such as at least 150 lumen (mean luminous flux), whereby some may be below 50 lumen, or 100 lumen, etc., and others may be above. The deviation from the minimum luminous flux is however especially less than 25%. Note that the minimum level of at least 50 lumen, even more especially at least 100 lumen (and similar phrases) relates to the lighting unit at maximum capacity. When this capacity is below about 100 lumen, especially below 50 lumen, the intensity provided by the lighting system may be too low. Further, the advantages of the grid definition, as given herein, may not be fully exploited. Especially, the minimum level is about 150 lumen. Further, good results can be obtained when the lighting system is configured to provide a luminous flux of at least 100 $lm/p^2$ (with p being the pitch in mm).

The lighting system may comprise at least 16 lighting units, such as 16-256 lighting units, like at least 32 lighting units, or at least 64 lighting units, though even more than 256 lighting units may be possible. Surprisingly, it was found that distances, especially pitches, in the range of 4-16 mm, especially 4-14, even more especially 6-14 mm, provides best results with respect to glare. According to simulations and measurements, there is a substantial increase in glare above about 25 mm; further there is a significant (further) decrease in glare below about 14 mm. Hence, especially below 14 mm glare may be minimal. Hence, in an embodiment the distances (d) between nearest neighbor lighting units are in the range of 6-14 mm.

Herein, the phrase "with in at least one direction center-to-center distances (d) between nearest neighbor lighting units" is applied. Assuming a regular configuration, there may be pitches in two (optionally orthogonal) directions that differ in value, such as this may be the case in a hexagonal configuration. In a cubic configuration, however, the pitches in perpendicular directions are the same. Further, as will be elucidated below, for certain applications the distances or pitches in one direction may be more relevant than in other directions. Hence, especially the invention provides a lighting system comprising at least 16 lighting units arranged in a grid with (in at least one direction) a pitch between nearest neighbor lighting units in the range of 4-16 mm, wherein each lighting unit comprises a light source and an optical element especially configured to control a beam shape of light generated by the light source, wherein each lighting unit is conjured to generate said light having a luminous flux of at least 50 lumen, such as at least 100 lm. Therefore, in an embodiment the grid is a regular grid with one or more pitches (p) in the range of 4-16 mm.

In principle, the configuration of the at least 16 lighting units may also be irregular, or a combination of regular grid distribution with therein further lighting units arranged irregular. In such configurations, instead of the term "pitch" the term "distance" may be used. At least in one direction, the arrangement of the lighting units have to comply with the above indicated distance condition. In an irregular system, or a combination of a of regular grid distribution with therein further lighting units arranged irregularly, in a specific embodiment the mean center-to-center distances (d) between nearest neighbor lighting units should be in the indicated range. For regular grids the mean center-to-center distances (d) in a direction will be the same as the pitch (in said direction).

The term "nearest neighbor" is known in the art. Further, for the definition of the distances between the lighting units the center-to-center distances are applied. In general, the shortest distances between adjacent lighting units in a direction is in the order of 0-90%, such as 40-80%, of the center-to-center distances in said direction. The conditions with respect to the center-to-center distances (d) between nearest neighbor lighting units should especially apply to at least 88% of all light sources, especially at least 94% of all light sources.

As indicated above, each lighting unit comprises a light source and an optical element (especially) configured to control a beam shape of light generated by the light source. The light source may be any light source may especially comprise a solid state LED light source (such as a LED or laser diode). The term "light source" may also relate to a plurality of light sources, such as 2-20 (solid state) LED light sources. Hence, the term LED may also refer to a plurality of LEDs. In the lighting unit, the optical element that is especially configured to control a beam shape of the light generated by the lighting unit controls the beam shape of the one or more light sources. Hence, when the optical element comprises a reflector, the one or more light sources are (at least partially) arranged in the reflector. When the optical element comprises a lens, the light of all one or more light sources will (at least partly) pass said lens. The optical element may comprise one or more of a reflector, a lens and a combination of a reflector and a lens. Especially, the optical element is thus not diffuse reflective neither translucent (respectively).

In a specific embodiment, the light source comprises a solid state light source and the optical element is selected from the group of a reflector and a lens. Hence, in a specific embodiment each lighting unit comprises a plurality of light sources and said optical element is configured to control a beam shape of light generated by the plurality of light sources, wherein each lighting unit is configured to generate said light having said luminous flux of at least 50 lm, especially at least 100 lm.

The phrase "wherein each lighting unit comprises a light source and an optical element especially configured to control a beam shape of light generated by the light source" especially indicates that at least 88%, even more especially at least 94% of all lighting units have such configuration of the light source(s) and the optical element especially configured to control a beam shape of light generated by the light source(s).

Especially, the light source(s) may be configured to generate white light. Note that in embodiments the term "light source" may thus refer to a plurality of light sources. The term white light herein, is known to the person skilled in the art. It especially relates to light having a correlated color temperature (CCT) between about 2000 and 20000 K, especially 2700-20000 K, for general lighting especially in the range of about 2700 K and 6500 K, and for backlighting purposes especially in the range of about 7000 K and 20000 K, and especially within about 15 SDCM (standard deviation of color matching) from the BBL (black body locus), especially within about 10 SDCM from the BBL, even more especially within about 5 SDCM from the BBL.

However, the light source may also be configured to generate colored light. Again, the term "light source" may refer to a plurality of light sources. In general, each light source will be configured provide substantially the same type of light, such as within 10% differences of the x and/or y coordinates of the CIE diagram. However, the light sources may in embodiments be tunable in color. Optionally, the plurality of light sources include one or more subsets of light source(s) that are individually controllable in one or more of color and intensity, especially at least in intensity.

Above, the lighting system was described with respect to a grid of at least 16 lighting units. In a specific embodiment the invention also provides a lighting system, wherein the lighting system comprises a plurality of grids, wherein between two nearest neighbor grids an intermediate region without a lighting unit is configured, and with in at least one direction a shortest distance (d2) between nearest neighbor grids of at least 50 mm. The same aspects concerning the directions apply here with respect to the shortest distance between nearest neighbor grids. Note however that the distance taken is the shortest distance, and not the pitch. Hence, the distance of at least 50 mm is a distance wherein in principle no light sources are found. This part or these parts are herein also indicated as intermediate regions.

The optical elements may especially be configured to provide a non-Lambertian distribution of the light that escapes from the lighting system. Especially, a beam is provided with an opening angle that is smaller than 160°, especially smaller than 145°. Within this opening angle, a substantial part of the luminous flux, such as at least 75% may be found. For sport lighting, the opening angle may especially be 4-60, such as 5-20°, with especially at least 75% of the intensity within this angle. For street lighting, the opening angle may especially be in the range of 145-160°, with especially at least 75% of the intensity within this angle. For industrial lighting, the opening angle may especially be in the range of 30-160°, with especially at least 75% of the intensity within this angle. Hence, especially, a beam is provided with an opening angle in the range of 4-160°, with especially at least 75% of the intensity within this angle.

In a specific embodiment, the at least 16 lighting units are configured to generate a beam of lighting system light, wherein the beam has an opening angle (A) in the range of 4-60° with at least 75% of the luminous flux within said opening angle (A), especially for specific applications such sport lighting or arena lighting.

In case two or more (spatially separated) grids are available, see above, the thus resulting beams may be directed parallel, but may also be directed in different directions. This may depend upon the desired application. Further, also with one gird more than one beam may be generated, dependent upon the configuration of the optical elements (i.e. the lenses and/or collimators). Especially however, each beam has an opening angle (A) in the range of 5-160° with at least 75% of the luminous flux within said opening angle.

The lighting system may in principle be arranged anywhere and at any location. The lighting system may be part of a standing configuration or a hanging configuration or a configuration one a floor or a ground, or partly integrated in a floor or in a ground (such as for wallwashing), etc. In a further aspect, the invention also provides a lamp comprising the lighting system as described herein, wherein the lamp further comprises a positioning element configured to position (during use of the lighting system) the lighting system at a distance of at least 3.0 m from a surface to be illuminated, especially at a height of at least 3.5 m over a surface. Especially, this distance may be 4 m, or even 4.5 m or higher. This may for instance be a stand, a post (for a lighting system), a tower (or a lighting system), etc. Optionally, the positioning element may also include an element for a suspension configuration of the lighting unit.

Note that the term "lighting system" may also refer to a plurality of lighting units, for instance as is generally the case in stadium lighting. Further note that where a plurality of lighting systems is applied, also in such configuration especially between two nearest neighbor grids an intermediate region without a lighting unit is configured, and with in at least one direction a shortest distance (d2) between nearest neighbor grids of at least 35 mm. As will be clear to a person skilled in the art, the invention also provides (such) lamp comprising a plurality of lighting systems as defined herein.

In yet a further aspect, the invention also provides an application of the lighting system as defined herein, or of the lamp as defined herein, wherein the lighting system is configured at a height of at least 3.0 m over a surface selected from the group consisting of an indoor floor or an outdoor area. For instance, in such application the lighting system may configured at an height of at least 3.5 m over a surface of a road. In general, the height for most of the applications will be larger, such as at least 4.5, even up to 50 m, or even higher. The term "application" especially refers to a combination of the lighting system and a surface to be illuminated by the lighting system, such as an indoor floor or an outdoor area.

In a specific embodiment, the application (thus) includes a road, and the road has a length axis, wherein the at least 16 lighting units of the lighting system are arranged in a grid with in at least one direction center-to-center distances (d) between nearest neighbor lighting units in the range of 4-16 mm, wherein the at least one direction is in a plane parallel to a plane of the road and perpendicular to the length axis of the road. In such embodiments, the pitch in a direction parallel to the length axis may be less relevant than in a direction perpendicular to the length axis, as people tend to move in a direction substantially parallel to the length axis. Lighting at crossings may thus be configured differently, with substantially all center-to-center shortest distances, especially where applicable all pitches, are in conformance with the herein indicated optimum distance(s).

In a further specific embodiment, the lighting system is configured to generate a beam of lighting system light, wherein the beam has an opening angle (θ) in the range of 4-160° with at least 75% of the luminous flux (see also above), and wherein the lamp is especially configured to provide said beam within an angle of 0-90° relative to a vertical to the earth's surface, especially 0-80° relative to a vertical to the earth's surface, even more specially 0-60° relative to a vertical to the earth's surface. Optionally, as already indicated above, the lamp may be configured to provide two (or optionally more) of such beams, directed to different directions, but for instance both with an optical axis in a plane perpendicular to the road and parallel to the length axis of the road. In further embodiments, the beam may be a circular or elliptical beam, with a lower intensity in the middle. Hence, the beam may have a (oval) ring like shape, with the ring having e.g. a circular or elliptical shape.

Hence, the invention allows the use of the lighting unit as described herein or the lamp as described herein, for illuminating a surface while minimizing glare for a person on said surface. This may apply to a person standing or walking on such surface, but also a person on or in a transport vehicle, such as a bike, motor, car, truck, bus, etc.

The human visual system evolved in a natural environment where high local gradients in luminance are rare. But, we should be able to see luminance contrasts over almost 5 orders of magnitude of luminance. To accomplish this, the neural system in our eyes is organized in a particular way. A cone feeds a signal into the visual system, depending on the local illuminance. For each cone, or little group of neighbouring cones, its signal is amplified depending on the illuminance on the surrounding cones. The retina contains many types of neurons. One of these types, so-called 'on-center' M ganglion cells, is responsible for this mechanism. Each of these ganglion cells collects the signal of one or a small group of cones—the center—and of a ring of cones surrounding the center—the surround. If little light falls on the surround, this is a sign to the ganglion cells that the overall light level is low and the signal produced by the center should be amplified. If the surround is strongly illuminated, this means that the signal of the center should be 'dimmed'. This mechanism works fine as long as the illuminance over a center-surround system does not vary too much. Also when the spatial frequency of the illuminance variation is high relative to the size of the center-surround system, this is experienced as a homogeneous illumination on the surround. However, if the illuminance at the retina shows gradients which cause the center to be highly light and the surround to be relatively 'dark' this system causes a problem: the low illuminance on the surround signals a low overall illuminance level and causes the controlling ganglion cell to amplify the signal of the center. But this signal was already high because of the high local illuminance. This very high signal rate causes the visual cortex to become very active, but with no actual meaningful 'visual content'. In most people this causes a feeling of discomfort and after a while fatigue. In more susceptible people, this effect can cause migraine or even epileptic attacks.

When looking at a grid of light points with a relatively large pitch between the LEDs, from a certain distance, the receptive fields will be illuminated more or less randomly. When the pitch is decreased, at a certain pitch, the visual angle between the individual LED images on the retina coincides with the visual angle of the receptive field centers. If the size of the LED images is of the same order of magnitude as the receptive field centers, but much smaller than the receptive field surrounds, this will cause the above-mentioned discomfortable effect. A further reduction in light point pitch will cause the receptive fields' centers and surrounds to be more and more homogeneously lighted, reducing the discomfort. So, there will be a 'medium' range of visual angles, which will give rise to the highest discomfort. In psychology, instead of visual angles, usually spatial frequencies (1/visual angle) are used to describe the spacing of the lighted pattern on the retina.

A number of configurations was tested with different pitches, optics (or non-optics), intensities, etc. Our experiments have shown that highest discomfort is experienced at spatial frequencies between 3 and 8 cycles per degree, with a maximum between 4 to 7 cycles per degree. In road lighting practice, the vast majority of poles is 4 meters and higher. Occasionally, especially in older lighting installations in urban/shopping areas, poles of 3.5 meter high are still found. In a dark scene, like those where relevant lighting installations would be found, the gaze of an observer is inadvertently, unconsciously, drawn towards points of high illuminance. From our experience, this effect is limited to visual angles smaller than 45 degrees from the horizon. In the typical road or street lighting fixture light distribution, the maximum intensity, and therefore the highest discomfort experience is found at an angle of about 20 degrees below the horizon.

Herein, the optical element is especially collimator or lens, or combination of two or more of these (e.g. primary and secondary optics), used to achieve the desired light distribution. Especially, the invention does not apply a translucent sealing member covering an area between the adjacent light-emitting diode chips. Hence, downstream of the optical element as defined herein, there is especially no translucent sealing member or other translucent window. The terms "upstream" and "downstream" relate to an arrangement of items or features relative to the propagation of the light from a light generating means (here the especially the first light source), wherein relative to a first position within a beam of light from the light generating means, a second position in the beam of light closer to the light generating means is "upstream", and a third position within the beam of light further away from the light generating means is "downstream".

Further, the term "light point" may be used. A light point: light emitting surface of an optical element covering or partially enclosing one or several LED packages. In systems where several dies are mounted under/in one optical element, these dies will not be discernable by the observer at practical distances (at least several meters), and the light emitting surface of the individual point in the grid will be seen/regarded as the light point. As indicated above, the pitch is the center-to-center distance between two adjacent light points. The term "lighting point" may thus refer to the lighting unit.

Further, the transverse direction in a road application is the lateral (left-to-right, horizontal) direction or axis as seen when looking down the road (usually parallel to the length axis of a road lighting fixture); the longitudinal direction: the axis parallel to the axis of the road. In most road lighting fixtures with distributed light points currently in the market, the LEDs are mounted in a regular square grid with a pitch of 25 mm. So a road user (driver or pedestrian) travelling and looking along the road will see a transverse pitch of 25 mm. Due to the angle at which the road user sees the fixture from some distance, the longitudinal pitch between the transverse rows will appear smaller. The distinction between transverse and longitudinal direction is not relevant in fixtures where there is no typical direction of view as e.g. in typical post top urban fixtures or architectural floodlights. A model build on our central insight and validated by our experiments predicts that with decreasing pitch, discomfort will be reduced.

Especially, the light points of the fixture or lighting system are positioned at a pitch smaller than about 16 mm, such as 15 mm, preferably even smaller than 12 mm. According to the current common understanding, reducing pitch at equal total flux, will reduce the light emitting surface, which at equal total flux, will increase glare. According to our research work based on our new insight, said reduction in pitch will significantly decrease instead of increase discomfort glare perception.

Temporary exposure to a source of sufficiently high brightness causes the formation of an afterimage, which is both disabling and discomfortable. After having glanced at a glare source, an afterimage of about the size of the source is formed at the retina. Glancing over a glare source produces a line-shaped afterimage, following the trajectory of the source over the retina. Obviously, a larger source causes a larger afterimage.

Let us consider the following LED grid as a reference, with a luminous flux per LED of 100 lm and with a pitch of 25 mm, corresponding to a luminous emittance of 160 klm·m-2, giving rise to considerable discomfort glare. Our work suggests that discomfort glare can be reduced by reducing the pitch between the LEDs. Now this can be achieved in two ways. Keeping the total flux of the system equal, we can increase the number of LEDs placed in the same light-emitting surface. As the luminance of the source is decreased, the reduction in discomfort glare is in line with the existing models and understanding. In fact, the perception of discomfort glare of people fixing their gaze at the light source decreases linearly with pitch. Alternatively, we can keep the total flux and the number of LEDs equal, just reducing the pitch and therefore reducing the size of the light-emitting surface. In this case, halving the pitch will reduce the light emitting surface with a factor 4, increasing the luminous emittance with the same factor. Contrary to current believes, in this case, discomfort glare will also be reduced considerably.

As mentioned before, the size of the light emitting surface determines the size of the afterimage. If the observer does not fix his gaze at the light source, but lets his gaze glance over it, the discomfort caused by the afterimage is even larger. Therefore in practical conditions, the discomfort glare perception of the smaller light source is even lower than in the static test shown here. So, due to the combination of both effects the latter option will result in a much lower, instead of a higher discomfort glare.

Initial tests show that if we compare the discomfort glare perception (dgp) of our reference matrix to a matrix with a luminous emittance (M) of at least 500 klm·m-2 and a pitch of maximum 14 mm, the dgp will be at least 16% lower. A reduction of pitch to below 12.5 mm with M≥640 klm·m-2, reduces dgp with at least 20%. A pitch of maximum 10 mm and M≥1 Mlm·m-2 will reduce dgp with more than 28%. Reducing the pitch below 8 mm and M≥1.5 Mlm·m-2 will reduce dgp with at least 35%.

From our observations we can conclude that if we consider grids of high power LEDs, discomfort glare can be reduced by reducing the pitch between the LEDs while keeping the luminous flux of the LEDs the same, thereby simultaneously increasing the luminous emittance accordingly. This can have additional benefits in product design and cost, as it allows the light emitting surface to become smaller. There is however a lower limit around a pitch of 8 mm due to the smallest possible size of the optics and due to thermal management. With the expected increases in flux and current density of LED dies, in the near future this limit might shift to 6 mm.

Amongst others we propose herein a lighting system build-up of at least 16 individual, discernible light points, directly visible to people near to the system, with each light point consisting of a collimating optical element (lens or collimator), covering one or more high power LEDs, further especially having at least one of the following features: (i) a nominal electrical power consumption of 0.5 W per LED, (ii) the flux emitted by a single light point is at least 50 lm, even more especially at least 100 lm, (iii) the total flux of the lighting system is at least 1600/2000 lm, (iv) with an average luminous emittance of the source of at least 0.5 preferably 0.64/1/1.5 Mlm·m-2 and a pitch between neighbouring light points of maximum 14 preferably 12.5, 12 or 10 mm, but larger than 8, preferably 6 mm, (v) a pitch between neighbouring light points of maximum 14 preferably 12.5, 12 or 10 mm, but larger than 8, preferably 6 mm, (vi) a luminous emittance of at least 100/p2 (with p being the pitch in mm), (vii) a maximum in the luminous intensity at an angle between 60 and 90 degrees to an axis perpendicular to the lighting system, (viii) where the light points are arranged in a square grid, or where the light points are arranged in a square grid where adjacent rows (or columns) are shifted half the size of the pitch (so-called checker-board pattern), or alternatively, where the light points are distributed semi-randomly, with the distance between a single LED and all other LEDs is either between 6 and 14/12/8 mm or larger than 50/60/75 mm (clusters of LEDs with small pitch, with larger distances between clusters).

The term "substantially" herein, such as in "substantially all light" or in "substantially consists", will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "and/or" especially relates to one or more of the items mentioned before and after "and/or". For instance, a phrase "item 1 and/or item 2" and similar phrases may relate to one or more of item 1 and item 2. The term "comprising" may in an embodiment refer to "consisting of" but may in another embodiment also refer to "containing at least the defined species and optionally one or more other species".

Furthermore, the terms first, second, third and the like in the description and in the claims, are used for distinguishing between similar elements and not necessarily for describing a sequential or chronological order. It is to be understood that the terms so used are interchangeable under appropriate circumstances and that the embodiments of the invention described herein are capable of operation in other sequences than described or illustrated herein.

The devices, systems, units, etc., herein are amongst others described during operation. As will be clear to the person skilled in the art, the invention is not limited to methods of operation or devices in operation.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "to comprise" and its conjugations does not exclude the presence of elements or steps other than those stated in a claim. The article "a" or an preceding an element does not exclude the presence of a plurality of such elements. The invention may be implemented by means of hardware comprising several distinct elements, and by means of a suitably programmed computer. In the device claim enumerating several means, several of these means may be embodied by one and the same item of hardware. The mere fact that certain measures are recited in mutually different dependent claims does not indicate that a combination of these measures cannot be used to advantage.

The invention further applies to a device comprising one or more of the characterizing features described in the description and/or shown in the attached drawings. The invention further pertains to a method or process comprising one or more of the characterising features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

The drawings are not necessarily on scale.

Figure 3:
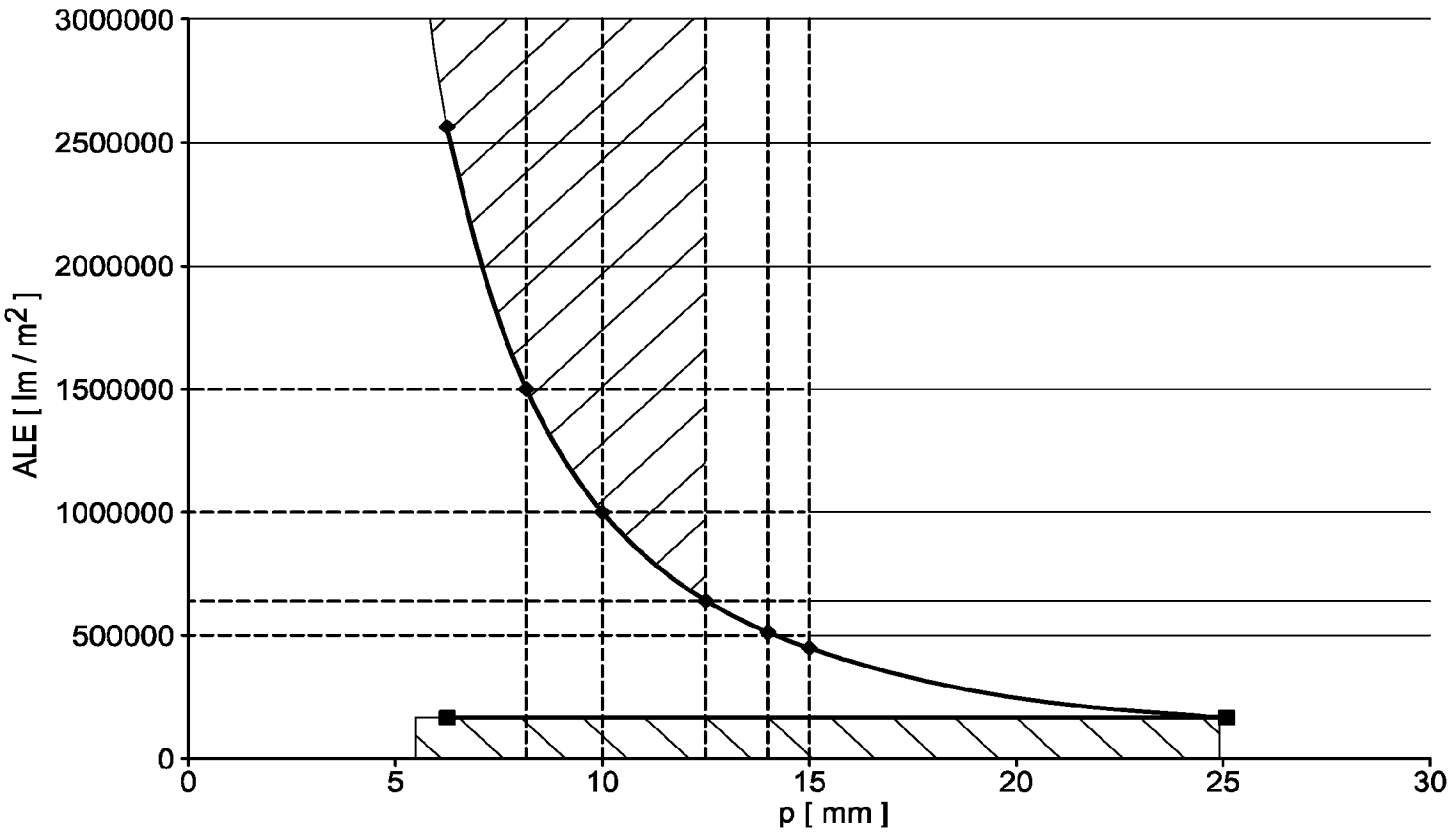

FIG. 3 depicts some the average luminous emittance (ALE) in $lm/m^2$ as function of the pitch (p) in mm. The dashed area between 6-14 mm pitch is especially desired.

DETAILED DESCRIPTION OF THE EMBODIMENTS

Figure 1A:
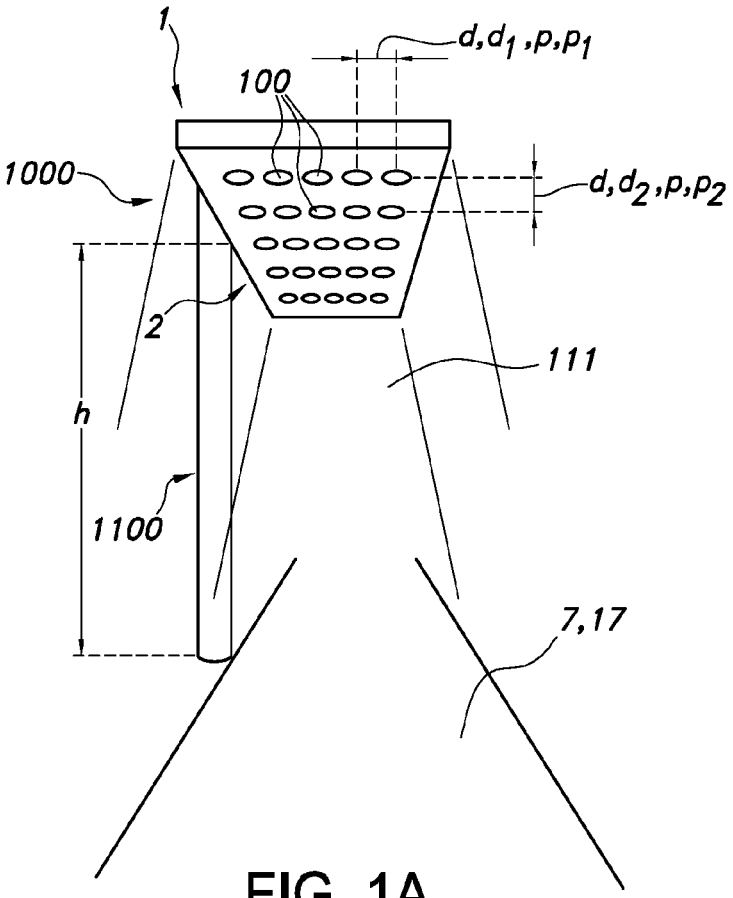
FIGS. 1*a*-1*b* schematically depict some embodiments and aspects of the invention.

FIG. 1*a* schematically depicts an embodiment of a lamp 1000 comprising a lighting system 1, wherein the lamp 1000 further comprises a positioning element 1100 configured to position the lighting system 1 at a distance, here height h, of e.g. at least 3.5 m, from a surface 7 to be illuminated. Surface 7 is in this embodiment a road 17. As the lighting system 1 comprises a regular grid 2 of lighting units 100, the center-to-center distances d are the same as the pitch p. In principle, there may be two (or more) center-to-center distances d, and thus pitches p. This is indicated with d1,d2 and p1,p2, respectively. In a regular cubic arrangement, d1=d2=p1=p2=d=p. The light generated by the lighting units 100 together provides the lighting system light 111. This light may be used to illuminate the surface 7.

Figure 1B:
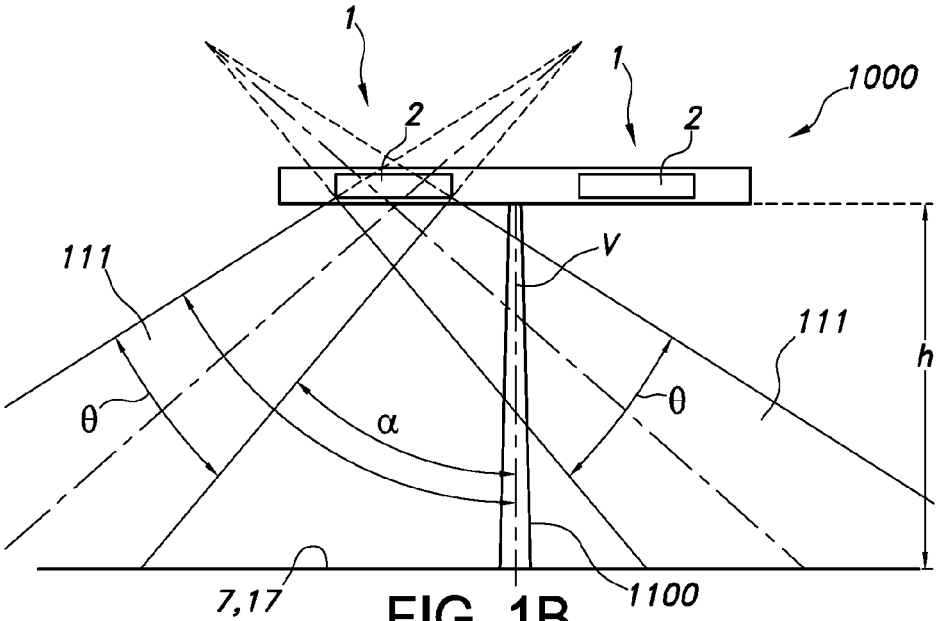

FIG. 1*b* schematically depicts a further embodiment, now in side view, of a lamp 1000. Here by way of example the lamp comprises (at least) two lighting systems 1, each having a grid 2. The two lighting systems may be configured to provide two or more beams, optionally in different directions. Here, one of the lighting systems 1 generates two beams of lighting system light 111, each having an opening angel theta θ. The value of 0 may differ for the beams. Especially, the opening angle θ is in the range of 4-160° with at least 75% of the luminous flux within said opening angle θ; here, in this schematic drawing θ is much smaller, such as in the range of 25°.

Hence, whether or not there are one or more distinguishable beams, within the angle θ, especially at least 75% of the luminous flux may be found.

Further, the lamp 1000 may be configured to provide said beam 111 within e.g. an angle α of 0-90° relative to a vertical (V) to said road 17. Again, at least 75% of the luminous flux within said angle α may be found. In an embodiment, the beam may be configured as circle or ellipse (i.e. on the surface 7 a circle or ellipse of light may be perceived), with a relative dark central part. Hence, FIG. 1*b* may also schematically depict a lighting unit 1 providing a oval or round beam (in side view). Here, by way of example a is in the range of 30-60°.

Figure 2A:
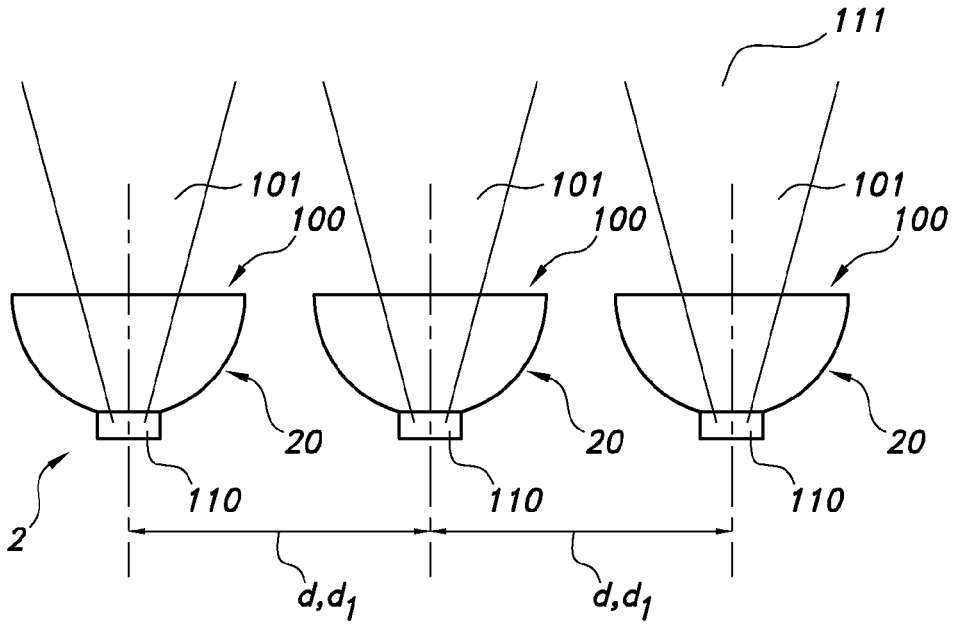
FIGS. 2*a*-2*d* schematically depict some aspects and variants of the invention.

FIG. 2*a* schematically depict in more detail an embodiment of a lighting system 1 comprising lighting units 100 arranged in grid 2 with in at least one direction center-to-center distances d between nearest neighbor lighting units, wherein each lighting unit 100 comprises a light source 110 and an optical element 20 (here at least collimators) configured to control a beam shape of light 101 generated by the light source 110. Especially, each lighting unit 100 may be conjured to generate said light 101 having a luminous flux of e.g. at least 100 lm.

Figure 2B:
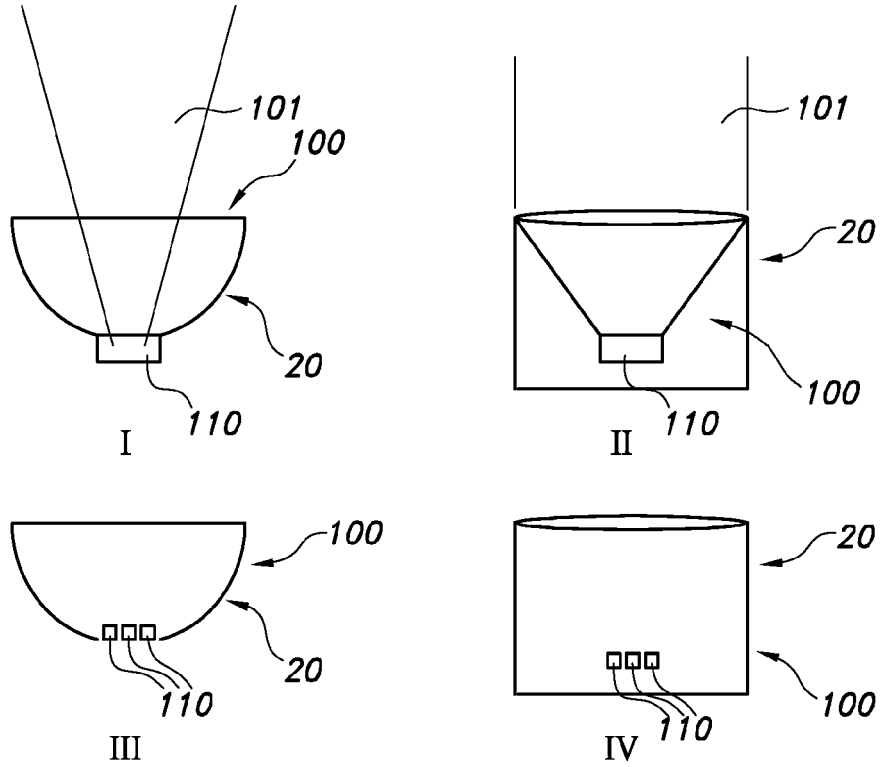

FIG. 2*b* very schematically depicts a non-limiting number of embodiments of the lighting units 100, with one (I/II) or more (III/IV) light sources 110 and with a collimator (I/III) or lens (II/IV), respectively. Combinations of different optical elements may also be applied. Especially, when more than one light sources 110 in the lighting unit 100 is applied, the light 101 of all those light sources is shaped into a beam by the optical element. Hence, there is at least one optical element by which the beam of light of all light sources 110 in the lighting unit 100 is shaped; the light sources do not need to have individual collimators or lenses. Optionally, however, this may also be the case.

Figure 2C:
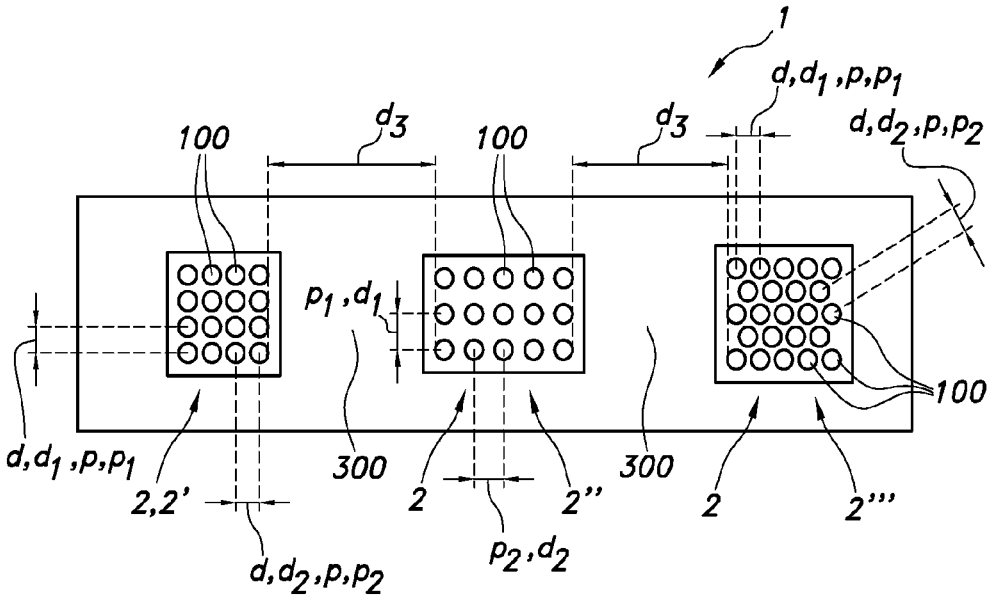
Figure 2D:
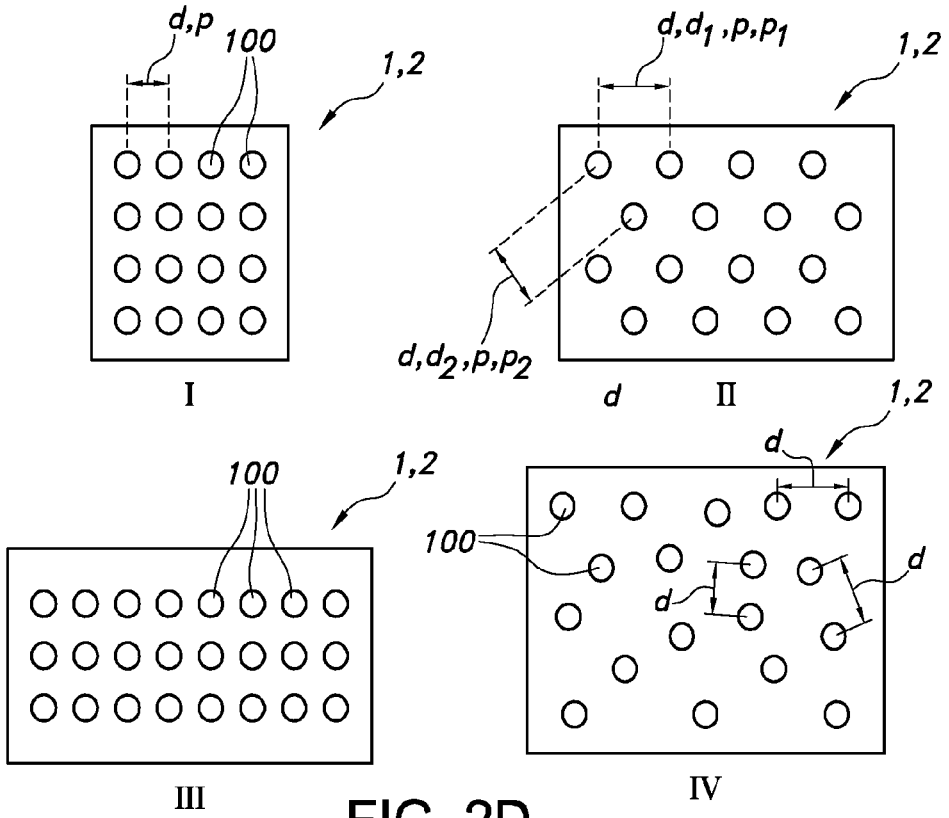

FIGS. 2*c* and 2*d* schematically depict some embodiments of grids 2, with in FIG. 2*c* schematically showing by way of example a lighting system 1 comprising three different grids. The left one (2') has a cubic configuration of the lighting units 100; the middle one (2") a grid 2 with two different orthogonal center-to-center distances or pitches, and the right one (2') a hexagonal arrangement, with center-to-center distances or pitches d1,d2 and p1,p2, respectively. The distances between the grids, is indicated with reference d3 (this is especially not a center to center distance, but a shortest distance between lighting units 100 of two different grids 2). Between the grids 2 there are intermediate regions 300 without lighting units (or optionally lighting units with intensities lower than 25% of the lighting units in the grids). Between two nearest neighbor grids 2 the intermediate regions 300 without lighting units 100 may be configured, with in at least one direction a shortest distance d3 between nearest neighbor grids 2 of at least 35 mm. FIG. 2*d* schematically depicts in more detail some embodiments of the grids 2, with I showing a cubic grid with one center-to-center distance or pitch p (i.e. d1=d2=p1=p2=d=p), II showing a hexagonal arrangement, III showing a grid with orthogonal pitches, and IV showing an irregular grid, with center-to-center distances d.

The invention claimed is:

1. A lighting system comprising:

at least 16 lighting units arranged in a grid with in at least one direction center-to-center distances between nearest neighbor lighting units in the range of 4-16 mm, wherein each lighting unit comprises a light source and an optical element configured to control a beam shape of light generated by the light source, wherein each lighting unit is configured to generate said light having a luminous flux of at least 50 lm, wherein the lighting system comprises as one integral luminous surface a plurality of grids, wherein between two nearest neighbor grids an intermediate region without a lighting unit is configured, and with in at least one direction a shortest distance between nearest neighbor grids of at least 35 mm.

2. The lighting system according to claim 1, wherein the distances between nearest neighbor lighting units are in the range of 6-14 mm.

3. The lighting system according to claim 1, wherein the light source comprises a solid state light source and wherein the optical element is selected from the group of a reflector and a lens.

4. The lighting system according to claim 1, wherein each lighting unit comprises a plurality of light sources and wherein said optical element is configured to control a beam shape of light generated by the plurality of light sources.

5. The lighting system according to claim 1, wherein the grid is a regular grid with one or more pitches in the range of 4-16 mm.

6. The lighting system according to claim 1, wherein two nearest neighbor grids have a shortest distance of at least 50 mm.

7. The lighting system according to claim 1, wherein the at least 16 lighting units are configured to generate a beam of lighting system light, wherein the beam has an opening angle in the range of 4-160° with at least 75% of the luminous flux within said opening angle.

8. A lamp comprising the lighting system according to claim 1, wherein the lamp further comprises a positioning element configured to position the lighting system at a distance of at least 3.0 m from a surface to be illuminated.

9. A lamp comprising a plurality of lighting systems according to claim 1.

10. The lighting system according to claim 1, wherein the lighting system is configured at a height of at least 3.0 m over a surface.

11. The lighting system according to claim 10, wherein the lighting system is configured at an height of at least 3.5 m over a surface of a road.

12. The lighting system according to claim 10, wherein the lighting system is configured to provide a luminous flux of at least 100 $lm/p^2$ (with p being the pitch in mm).

13. The lighting system according to claim 11, wherein the road has a length axis, wherein the plurality of lighting units of the lighting system are arranged in a grid with in at least one direction center-to-center distances between nearest neighbor lighting units in the range of 4-16 mm, wherein the at least one direction is in a plane parallel to a plane of the road and perpendicular to the length axis of the road.

* * * * *